US005308399A

United States Patent [19]

Pillhoefer et al.

[11] Patent Number: 5,308,399

[45] Date of Patent: May 3, 1994

[54] METHOD AND APPARATUS FOR COATING A STRUCTURAL COMPONENT BY GAS DIFFUSION

[75] Inventors: Horst Pillhoefer, Roehrmoos; Martin Thoma, Munich; Heinrich Walter, Friedberg; Peter Adam, Dachau, all of Fed. Rep. of Germany

[73] Assignee: MTU Motoren- und Turbinen-Union Muenchen GmbH, Munich, Fed. Rep. of Germany

[21] Appl. No.: 72,149

[22] Filed: Jun. 4, 1993

Related U.S. Application Data

[62] Division of Ser. No. 899,762, Jun. 17, 1992.

[30] Foreign Application Priority Data

Jun. 18, 1991 [DE] Fed. Rep. of Germany ..... 4119967

[51] Int. Cl.[5] ..... C23C 14/00; C23C 16/00

[52] U.S. Cl. ..... 118/719; 118/715; 118/725; 118/726

[58] Field of Search ..... 118/719, 725, 726, 715

[56] References Cited

U.S. PATENT DOCUMENTS

| | | | |
|---|---|---|---|
| 3,640,815 | 2/1972 | Schwartz | 427/252 |
| 3,904,789 | 9/1975 | Speirs | 427/252 |
| 4,009,146 | 2/1977 | Cork | 427/229 |
| 4,096,296 | 6/1978 | Galmiche | 427/252 |
| 4,132,816 | 1/1979 | Benden | 427/253 |
| 4,260,654 | 4/1981 | Baldi | 427/253 |
| 4,439,470 | 3/1984 | Sievers | 427/252 |

FOREIGN PATENT DOCUMENTS

| | | |
|---|---|---|
| 2805370 | 8/1979 | Fed. Rep. of Germany . |
| 1433497 | 2/1966 | France . |

*Primary Examiner*—Richard Bueker
*Attorney, Agent, or Firm*—W. G. Fasse; W. F. Fasse

[57] ABSTRACT

Inner and outer surfaces of structural components are aluminized by an aluminum gas diffusion process. For this purpose a gas mixture of a halogenous gas, aluminum monohalide gas, hydrogen, and negligible proportions of aluminum trihalide gas is caused to flow over the outer and inner surfaces of the component to be coated. The process is performed in a vessel in which at least two different temperature zones are maintained for keeping one or more aluminum sources at a higher temperature than the component to be coated. Especially gas turbine engine blades are protected against oxidation and corrosion by the so formed aluminum diffusion coatings on outer and inner surfaces of the blades.

3 Claims, 2 Drawing Sheets l/mm
400
300
19
200
100
900
1000
T/°C
8
7
I
II
III
4
3
2
4A
4B
5
1
6
B
A l/mm
400
300
19
200
100
900
1000
T/°C
8
7
10A
11
10B
I
II
III
4
3
2
4A
11A
4B
5
9
10
12
A
B
A

METHOD AND APPARATUS FOR COATING A STRUCTURAL COMPONENT BY GAS DIFFUSION

CROSS-REFERENCE TO RELATED APPLICATIONS

This is a divisional of U.S. patent application Ser. No. 07/899,762, filed: Jun. 17, 1992 pending.

FIELD OF THE INVENTION

The invention relates to a method and an apparatus for aluminum coating outer and inner surfaces of structural components, e.g. turbine blades, by gas diffusion.

BACKGROUND INFORMATION

German Patent Publication (DE-OS) 2,805,370 discloses a method and an aluminized coating for drilled passages in turbine blades. The known aluminized coating has the disadvantage that it is deposited at low temperatures between 700° C. and 850° C., whereby an aluminum diffusion into the surface of the component is prevented. For aluminizing components, the known method passes a carrier gas, such as hydrogen, through aluminum trihalide, which at temperatures above 900° C., is subsequently converted into aluminum subhalide over a pool of liquid aluminum or a liquid aluminum alloy. Thereafter, pure aluminum is deposited in inner bores of the structural component.

It is an essential disadvantage of the known method that for converting thermally stable aluminum trihalide into aluminum subhalide, liquid aluminum or aluminum alloys must be formed within the deposition reactor. The resulting aluminum monohalide formed in the process is impure. Rather, a substantial proportion of at least 20% aluminum trihalide remains in the mixture, whereby the aluminum deposition rate is reduced. A further disadvantage of this method is seen in that it requires the installation of melting crucibles in the deposition reactor.

In addition, the absorption and formation of aluminum monohalide is limited by the limited reaction surface area of the melt in the crucible.

French Patent Publication FR-PS 1,433,497 discloses an aluminum gas phase deposition process, wherein aluminum or aluminum alloy particles are used as an aluminum source and the source temperature is too low for the aluminum source to melt. A halogen gas is passed through the aluminum source for forming aluminum halides. The disadvantage of this known method is its low aluminum source temperature, which prevents achieving high deposition rates.

U.S. Pat. No. 4,132,816 discloses how to achieve higher deposition rates by adding activators, such as alkaline or alkaline earth halides or complex aluminum salts to the aluminum source. These additives, however, disadvantageously reduce the purity of the aluminized coating, especially since the substances admixed to the source material comprise not only activators, but also oxides, such as aluminum oxide.

OBJECTS OF THE INVENTION

In view of the foregoing it is the aim of the invention to achieve the following objects singly or in combination:

- to provide a method and an apparatus for a gas diffusion aluminizing inner and outer surfaces of structural components which eliminate the need for aluminum or aluminum alloy melts as aluminum sources;
- to achieve a high deposition rate at a high purity of the resulting aluminum coating;
- to avoid oxidic, alkaline or alkaline earth inclusions in the aluminum coating;
- to achieve a uniform deposition rate over the entire surface to be coated regardless whether an inner surface or an outer surface is to be coated and so that the resulting aluminum coating has a substantially uniform thickness;
- to avoid the use of a halogen containing gas during a heat-up and cooling phase, thereby preventing an uncontrolled etching of the surface to be aluminized.
- to use an efficiently high flow speed for the deposition gas flow without the need for a high effort and expense for the flow control; and
- to provide a simple, yet efficient apparatus for the performance of the present method in such a way that the aluminum source can be heated to a higher temperature than the structural component to be coated.

SUMMARY OF THE INVENTION

According to the present invention there is provided a method wherein a mixture of halogenous gas, hydrogen, aluminum monohalide gas, and negligible aluminum trihalide gas contents is formed by passing halogenous gas and hydrogen through heatable metallic aluminum compound particles, which form the aluminum source, and then directing the gas mixture to flow over the surfaces of the component to be coated, said surfaces including inner and/or outer component surfaces.

The present method has, among others, the advantage that by using metallic aluminum compound particles having a high melting point, the aluminum source of heatable particles will not form a melt even when the source temperature substantially exceeds the temperature level at which an appreciable aluminum diffusion into the surface of the component begins. This feature has the further advantage that aluminizing of the inner and outer component surfaces is achieved in combination with a limited degree of uniform aluminum diffusion into the surface of the structural component resulting in an excellent bonding strength between the aluminum coating and the structural component.

Moreover, metallic aluminum compounds permit the use of sufficiently high source temperatures to advantageously cause the halogenous gas flow to form aluminum monohalides of high concentrations in the source region, whereby the aluminum trihalide content becomes negligible. This feature has the further advantage of a high deposition rate of aluminum on the inner and outer surfaces of the component.

In a preferred embodiment of the present invention, the gas mixture comprises 3 to 6 parts aluminum monohalide and 1 to 3 parts halogenous gas and hydrogen. The advantage afforded by this preferred range of composition of the gas mixture following its passage through the aluminum source, is that it unexpectedly boosts the deposition rate over prior art by a factor of 1.5. The just stated "parts" ratios are by molecular weight.

In a further preferred embodiment of the invention the aluminum monohalide content in the gas mixture used for coating outer component surfaces is diluted down to as little as one-hundredth of the aluminum monohalide content in the gas for coating inner component surfaces. This dilution is achieved by supplying the aluminum sources for outer and inner surface coatings, respectively, with separate flows of carrier gas, whereby the halogenous gas content of the carrier gas for the outer surface coating is reduced by a factor of up to 100 from that for the inner surface coating.

It has been found that differing source temperature levels for outer and inner surface coatings, respectively, will also dilute the aluminum monohalide content for the outer surface coating. For this purpose the source temperature for the outer surface coating is made lower than the source temperature for the inner surface coatings. This feature of the invention has the advantage that the thickness of the coating can be selected to suit the different operational requirements of component inner and outer surfaces, respectively. This feature can also be used to advantageously counteract drops in the deposition rate when gas diffusion coating inner surfaces.

For performing a gas diffusion coating according to the invention, both the component to be coated and the aluminum source are arranged in a multi-zone furnace. This arrangement affords an advantage over the method according to French Patent 1,433,497 (FIG. 2 therein) in that different temperatures can be maintained for the aluminum source and the component by suitably arranging these members in the multi-zone furnace, so that the need for heating connecting pipes is eliminated. The process temperature of the aluminum source is preferably maintained at a level up to 300° C. above the component temperature, which is preferably maintained at between 800° C. and 1150° C. for a period of 0.5 to 48 hours. Even at low component temperatures, the temperature of the aluminum source in the multi-zone furnace can advantageously be raised high enough to keep the aluminum trihalide content in the gas mixture negligibly small.

Further improvement is achieved according to the invention by preferably using particles of intermetallic phases of aluminum and of the base alloy of the component to be coated, for the aluminum sources.

The constituents of the base alloy of which the component to be coated is made, exhibit high aluminum proportions in the stoichiometric composition with at least 3 aluminum atoms for 1 metal atom. This feature assures that the component coating is very pure, since no elements are involved in the gas diffusion method other than are also present in the component or the coating. Therefore, preferred use is made of the intermetallic phases $NiAl_3$, $FeAl_3$, $TiAl_3$, $Co_2Al_9$, $CrAl_7$, $Cr_2Al_{11}$, $CrAl_4$ or $CrAl_3$ or phase mixtures in particle form for the aluminum source.

When gas diffusion coating inner surfaces, a preferred flow velocity of between $10^{-1}$ and $10^4$ m per hour is selected. These flow speeds along the inner surfaces to be coated have the advantage that the deposition rate along the length of the inner surfaces, and hence the thickness of the coating, is equalized. In other words, a uniform deposition on the entire surface to be coated results in a uniform, or substantially uniform coating thickness on the entire coated surface.

A further preferred embodiment of the invention replaces the coating gas mixture by a pure inert gas during a heating phase prior to a coating phase and a cooling phase following the coating phase, thus preventing the admission of halogenous gas during the heating and cooling phase, whereby the risk of excessively high concentrations of aluminum trichloride in the gas mixture, which might cause random halide etching on the component surface, is avoided. The process pressure during a deposition or coating phase between the heating phase and the cooling phase, is preferably selected within the range of about $10^3$ to $10^5$ Pa. This pressure range advantageously permits achieving the high flow velocities along the inner surfaces to be coated, with a relatively modest control effort and expense.

The apparatus of the present invention comprises at least one heating device, a retort chamber, and at least one aluminum source for implementing the present method, wherein said heating device is a multi-zone furnace, and wherein said retort chamber comprises two carrier gas inlet pipes and two separate aluminum sources for separately coating the component inner and outer surfaces, and wherein a common outlet pipe is provided for the reaction gases.

The advantages of the present apparatus are seen in that it enables the formation of a gas mixture of halogen gas, hydrogen, aluminum monohalide gas and a negligible proportion of aluminum trihalide gas, since the heatable partices of metallic aluminum compounds forming the aluminum source can be heated to a temperature above that of the components to be coated. Therefore, temperatures for the aluminum source can advantageously be maintained at levels at which aluminum trihalides become unstable.

A further advantage of this apparatus is seen in that separate gas flows are formed for coating outer and inner surfaces respectively and these gas flows can be adjusted with respect to flow velocity and the aluminum monohalide concentration is also adjustable. Separate flow velocities are achieved by means of separate gas inlet pipes for the coating of outer and inner surfaces, respectively. Different concentrations or proportions of aluminum monohalide in the different gas mixtures for coating outer and inner surfaces, respectively, are preferably achieved by separating the aluminum sources and associated gas supplies. The need for heating means for the inlet pipes between the aluminum source or sources and the component to be coated, is advantageously obviated by arranging the retort chamber in a multi-zone furnace.

The present method and apparatus find preferred use for simultaneously coating inner and outer surfaces of gas turbine engine blades.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
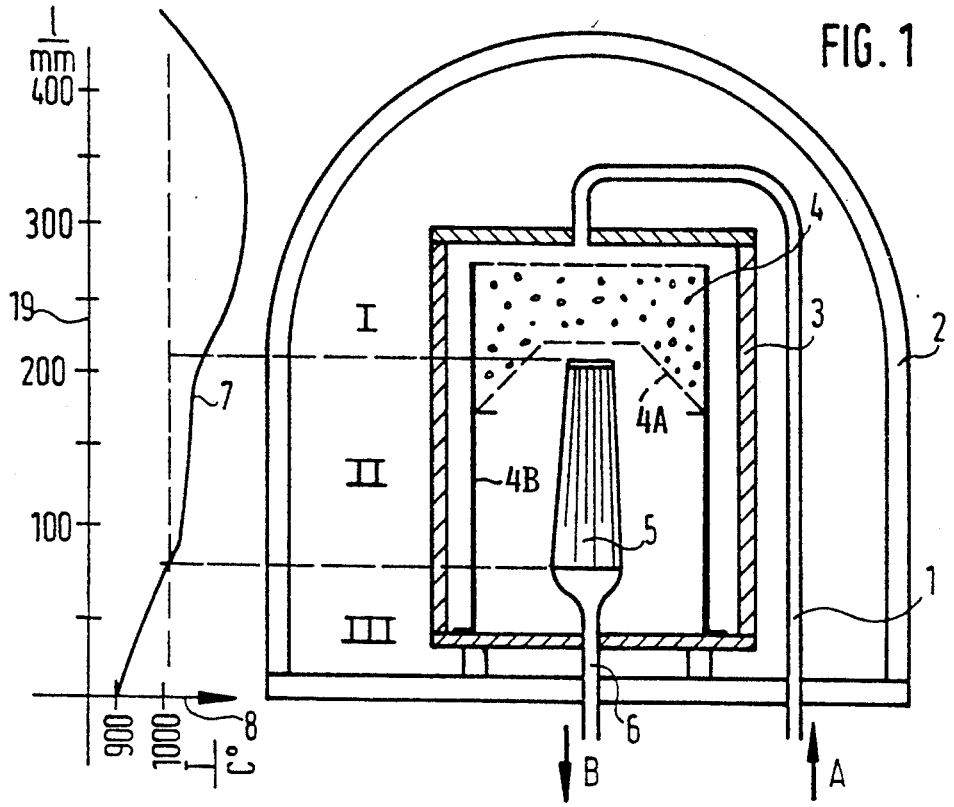
FIG. 1 is a schematic drawing illustrating the method of the invention.

FIG. 1 shows schematically the performance of the present method of aluminizing a component 5, e.g. a turbine blade 5, in a chamber 3. A stream of gas containing a gas mixture of anhydrous hydrochloric or hydrofluoric acid and hydrogen in a 1:3 to 1:20 mole ratio, is caused to flow through an inlet pipe 1 in the direction indicated by an arrow A into the chamber 3 forming a retort chamber inside a pressure vessel 2. The gas mixture is routed through an aluminum source 4 in the form of metallic aluminum compound particles held on a screen 4A in a container 4B in the chamber 3.

In this embodiment only one aluminum source 4 is arranged in the hottest region of the retort chamber 3. The temperature distribution along the axial, vertical length L in mm, is shown in the left-hand part of FIG. 1. Three temperature zones I, II, and III are discernible.

As the gas mixture flows through the aluminum source 4, aluminum monohalide is being formed. For this purpose, the aluminum source 4 is located in the first temperature zone I where the source 4 is heated to a temperature up to 300° C. above that of the component 5 in the second temperature zone II. The outer and inner surfaces of the component 5 are maintained at a temperature within the range of about 800° C. to about 1150° C. Additionally, a temperature gradient of 1° C. to 3° C. per lmm axial length of the component 5 is established, whereby the blade tip is at the higher temperature as shown in FIG. 1. In its passage through the aluminum source 4 the gas mixture is being enriched with aluminum monohalide, so that the outer surfaces of the component 5 are now swept by or contacted by a gas mixture of one molar part of anhydrous hydrochloric or hydrofluoric acid and four molar parts of aluminum monohalide. In the embodiment of FIG. 1, the inner surfaces of the component 5 are swept or contacted by the same gas mixture through openings such as bores between the outer and inner surface for depositing an aluminum coating on inner and outer component surfaces in the process.

The inner surfaces of the component 5 communicate with a gas outlet pipe 6 such that when the aluminum has been deposited on the inner surfaces, the residual gases escape from the retort chamber 3 as indicated by the arrow B.

The process pressure in the pressure vessel 2 during the aluminum deposition and diffusion process is maintained within the range of about $10^3$ to about $10^5$ Pa.

The above mentioned temperature zones I, II, III are established in a multi-zone furnace to provide a vertical temperature profile 7 in the center of the pressure vessel 2 which is placed into such a furnace. In FIG. 1 the level of temperature T of the temperature profile 7 is shown in centigrade degrees on the abscissa 8, and the location along the length L of the pressure vessel 2 is shown in millimeters on the ordinate 19.

Figure 2:
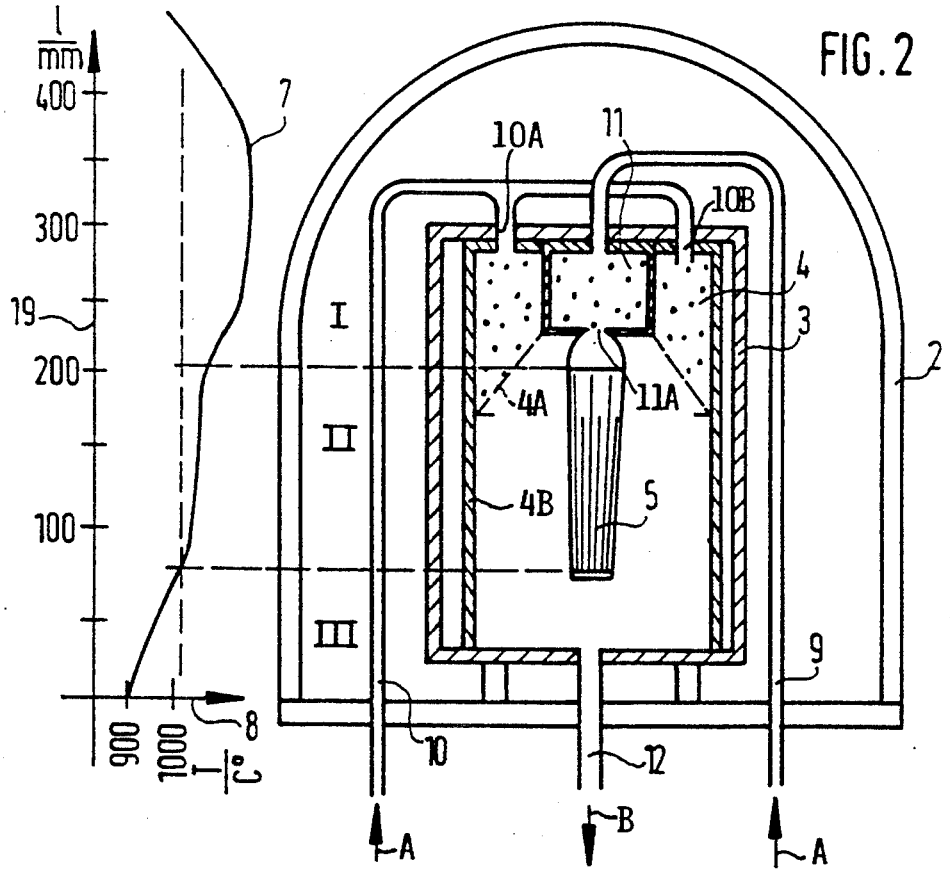
FIG. 2 illustrates a preferred apparatus according to the invention for implementing the present method.

FIG. 2 shows a preferred apparatus for implementing the present method using at least one conventional heating device for again establishing three temperature zones I, II, and III in the retort chamber 3. At least one aluminum source 4, preferably two such sources 4 and 11 are separately arranged in the chamber 3. The heating device is a multi-zone furnace into which the vessel 2 is placed. The retort chamber 3 is connected to two carrier gas inlet pipes 9 and 10. Pipe 9 leads into the aluminum source 11. Pipe 10 leads with its branching ends 10A and 10B into the aluminum source 4 for separately coating outer and inner surfaces of the component 5. A common outlet pipe 12 discharges the reaction gases in the direction of the arrow B.

Figure 3:
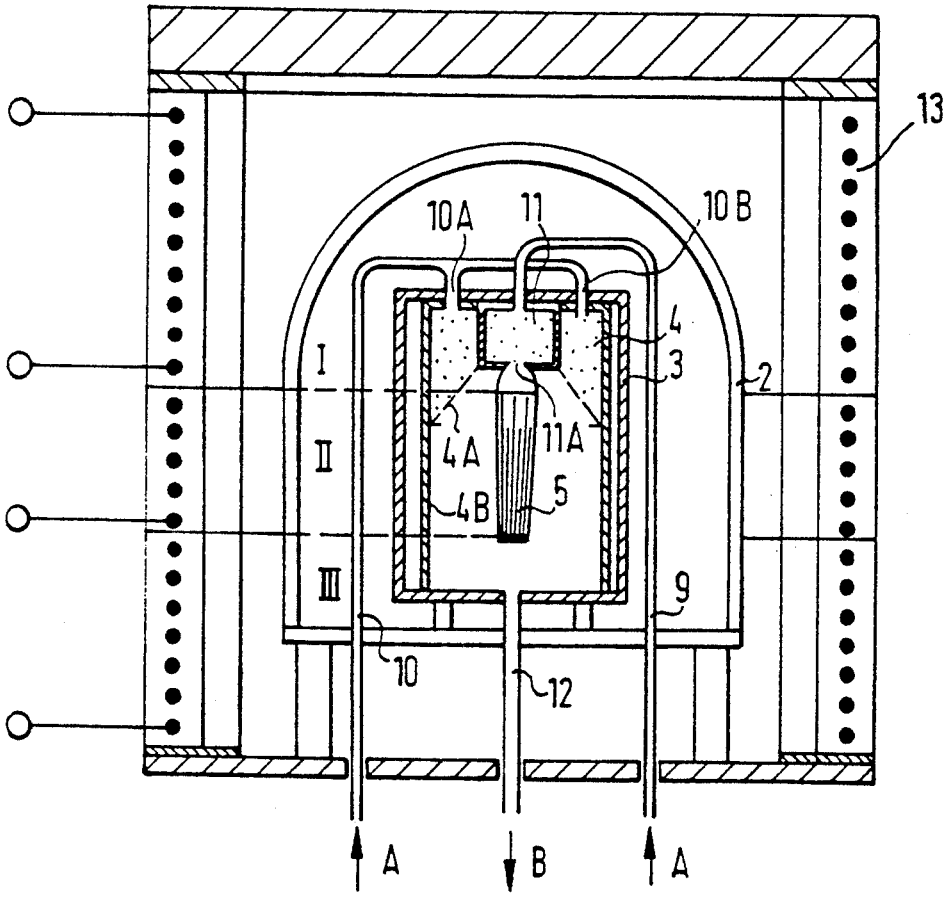
FIG. 3 shows the embodiment of FIG. 2 in a furnace having several heating zones controllable independently of each other.

At the start of a gas diffusion cycle, the apparatus is first baked-out and heated with the aid of the multi-zone furnace of FIG. 3. In this heat-up phase a negative pressure of, e.g., $10^3$ Pa is maintained in the pressure vessel 2 to ensure that the components of the apparatus and the materials in the pressure vessel 2 are outgassed. Simultaneously, an inert carrier gas is routed through the carrier gas inlet pipes 9 and 10 and through the retort chamber 3 as indicated by the arrowheads A and B to flush the retort chamber 3 and the cavities in the component 5. The flushing gas may flow through the aluminum sources 4 and 11 since it is inert. Upon completion of the heat-up phase, the multi-zone furnace is controlled to establish the temperature profile 7 along the vertical center axis of the pressure vessel 2.

Following the heat-up phase, a gas mixture of anhydrous hydrochloric or hydrofluoric acid and hydrogen is routed through the aluminum sources 4 and 11 in the retort chamber 3 through the carrier gas inlet pipes 9 and 10. The aluminum sources 4 and 11 are arranged in the hottest temperature zone I of the retort chamber 3. The screen 4A holds the aluminum or aluminum compound particles in the source 4, as in FIG. 1.

In the aluminum source 4, aluminum monoxide is formed for coating the outer surfaces of the component 5, while in the separate aluminum source 11 aluminum monoxide is formed for coating the inner surfaces of the component 5. In the diffusion process the aluminum monoxide content or concentration in the gas mixture for coating the outer surfaces is made as much as 100 times lower than the aluminum content of the gas mixture for coating the inner surfaces. For this purpose, the flow and concentration of halides in the carrier gas inlet pipe 10 is reduced compared to the halide flow and concentration levels in the carrier gas inlet pipe 9.

The inner and outer surfaces of the component 5 communicate with a gas outlet pipe 12, so that when the aluminum deposition cycle on the outer and inner surfaces has been completed, the residual gases can escape from the retort chamber 3 as indicated by the arrow B.

Although the invention has been described with reference to specific example embodiments, it will be appreciated that it is intended to cover all modifications and equivalents within the scope of the appended claims.

The aluminum source particles have a particle size within the range of 0.5 mm to 40 mm particle diameter, preferable 5 mm to 20 mm.

What we claim is:

1. An apparatus for aluminizing surfaces of a structural component, comprising a retort chamber, two aluminum sources in said retort chamber, means for heating different zones of said retort chamber to different temperatures, one of said zones having the highest temperature holding said aluminum sources, a first diffusion gas conduit for feeding a diffusion gas mixture through one of said aluminum sources for diffusion coating an outer surface of said structural component in said retort chamber, a second diffusion gas conduit for feeding a further diffusion gas mixture through the other of said aluminum sources for diffusion coating inner surfaces of said structural component in said retort chamber and a common gas discharge conduit connected to said retort chamber.

2. The apparatus of claim 1, further comprising a pressure vessel, wherein said retort chamber is mounted.

3. The apparatus of claim 1, wherein said means for heating comprise a multi-zone furnace.

* * * * *